US006390384B1

(12) United States Patent
Sato et al.

(10) Patent No.: US 6,390,384 B1
(45) **Date of Patent: *May 21, 2002**

(54) FUEL INJECTION DEVICE FOR DIESEL ENGINE

(75) Inventors: Hiroki Sato, Oyama (JP); Jiro Akagi, Columbus, IN (US)

(73) Assignee: Komatsu Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/284,359

(22) PCT Filed: Oct. 7, 1997

(86) PCT No.: PCT/JP97/03581

§ 371 Date: Apr. 12, 1999

§ 102(e) Date: Apr. 12, 1999

(87) PCT Pub. No.: WO98/16735

PCT Pub. Date: Apr. 23, 1998

(30) Foreign Application Priority Data

Oct. 14, 1996 (JP) ..... 8-291167

(51) Int. Cl.[7] ..... F02M 47/02

(52) U.S. Cl. ..... 239/91; 239/88; 239/95; 239/533.4; 239/533.12

(58) Field of Search ..... 239/88, 89, 91, 239/92, 93, 94, 95, 533.3, 533.4, 533.12

(56) References Cited

U.S. PATENT DOCUMENTS

| | | | | | |
|---|---|---|---|---|---|
| 1,657,395 | A | * | 1/1928 | Held | 239/533.12 |
| 2,095,889 | A | * | 10/1937 | Pokorney | 239/88 |
| 3,355,108 | A | * | 11/1967 | Cummins, Jr. | |
| 4,691,674 | A | * | 9/1987 | Otsuka et al. | 239/533.4 |
| 5,076,236 | A | * | 12/1991 | Ye et al. | 239/88 |
| 5,275,337 | A | * | 1/1994 | Kolarik et al. | 239/91 |
| 5,445,323 | A | * | 8/1995 | Perr et al. | 239/91 |
| 5,458,292 | A | * | 10/1995 | Hapeman | 239/533.4 |

FOREIGN PATENT DOCUMENTS

| | | | | |
|---|---|---|---|---|
| EP | 418601 | * | 3/1991 | 239/533.3 |
| FR | 899613 | * | 6/1945 | 239/533.4 |
| JP | 2-294551 | | 12/1990 | |
| JP | 3-206351 | | 9/1991 | |
| JP | 6-503147 | | 4/1994 | |
| JP | 7-49055 | | 2/1995 | |
| JP | 2524657 | | 5/1996 | |
| RU | 1240945 | * | 6/1986 | 239/533.3 |

* cited by examiner

*Primary Examiner*—Henry C. Yuen
*Assistant Examiner*—Christopher S. Kim
(74) *Attorney, Agent, or Firm*—Sidley Austin Brown & Wood LLP

(57) ABSTRACT

The present invention provides a wide range injection timing, small dispersion, good response and simple structure. In order to obtain this, in a fuel injection device for a diesel engine comprising a cylindrical body (11), an upper plunger (12) inserted thereto and capable of sliding in a vertical direction in response to a cam, an intermediate plunger forming a pressure chamber (14) with respect to the upper plunger, a lower plunger (16) brought into contact with the intermediate plunger, and an injection chamber (17) provided in a lower end portion of the body plunger, in which a fuel in the injection chamber is injected by the lower plunger being subject to a force from the upper plunger, the improvement comprises a passage, having a large cross-sectional area, formed in the body for supplying a pressurized oil to the pressure chamber, the intermediate plunger (13) being vertically movable in response to an oil pressure so as to make it possible to change a volume of the pressure chamber, and a timing spring (15) having an end being brought into via contact with the intermediate plunger and the other end being brought into contact with the lower plunger and vertically moving the intermediate plunger in response to the pressure.

10 Claims, 3 Drawing Sheets

FUEL INJECTION DEVICE FOR DIESEL ENGINE

FIELD OF THE INVENTION

The present invention relates to an injection device for a diesel engine, and more particularly to a unit injector for high pressure injection for a diesel engine.

BACKGROUND ART

In recent years, a unit injector for a high pressure injector for high pressure injection for a diesel engine has been strongly desired in order to improve air pollution due to the diesel engine and reduce fuel consumption. For example, in Japanese Patent No. 2524657, there is suggested a high pressure unit fuel injector provided with a variable length hydraulic link, for controlling an injection timing, and an injection pressure control valve. The fuel injector achieves improved pressure control without adversely influencing a controlled amount of a timing fluid.

FIG. 4 is a cross sectional view of a fuel injector 50 for high pressure injection described in the publication. An upper plunger 51, subject to a drive force from a cam shaft (not shown), is closely arranged in a cylinder hole 53 in such a manner as to freely slide in a vertical direction due to an upward force by a spring 52. A timing chamber 55 capable of changing a volume is formed between a lower end of the upper plunger 51 and an intermediate plunger 54. A timing fluid 56 such as a fuel is supplied to the timing chamber 55 via a narrow timing fluid passage 59 formed in an injector barrel 58. The timing fluid 56 forms a hydraulic link between the intermediate plunger 54 and the lower plunger 61, and is preferably discharged under a certain condition via a first drain passage 62 formed in a direction of a central axis through the intermediate plunger 54. Further, the timing chamber 55 communicates with a compensation chamber 63 via a valve mechanism 70 in a bottom portion of the first drain passage 62. The valve mechanism 70 is held between the lower end portion of the intermediate plunger 54 and the upper end portion of the lower plunger 61 arranged within the compensation chamber 63. When the valve mechanism 70 is opened, the timing fluid 56 flows within the compensation chamber 63 from the timing chamber 55 via the first drain passage 62 and is discharged out of the fuel injector 50 via a second drain passage 64. The valve mechanism 70 controls a pressure of the timing fluid 56 within the timing chamber 55, and next, the pressure controls an upper limit of the injection pressure of the fuel and a timing of the injection. The valve mechanism 70 is normally closed by application of a force due to a timing spring 65 arranged within the compensation chamber 63 and a valve spring 66 arranged within the lower plunger 61. Further, the force of the timing spring 65 pulls up the lower plunger 61 and operates so that three plungers, comprising the lower plunger 61, the intermediate plunger 54, and the upper plunger 51, are integrated until a controlled amount and a timing in the next cycle start after a completion of the injection cycle. A supply of the timing fluid 56 to the timing chamber 55 is performed through the narrow timing fluid passage 59. The injection timing is changed in accordance with a supplied amount of the timing fluid 56. For example, when the supplied amount is much, the injection timing is quickened. The timing spring 65 moves the lower plunger 61 upwardly a degree sufficient to feed out the fuel to an injection chamber 73 adjacent to an injection nozzle 71.

Next, when the injection timing is established by the supply of the timing fluid 56 within the timing chamber 55, the injected fuel flows within the injection chamber 73 via a supply orifice 75 of a fuel supply passage 74. The injected fuel in the injection chamber 73 is accurately controlled in accordance with a known pressure/time principle. An amount of the injected fuel controlled in the above manner becomes a function of a total control time for fluid flow through the fuel supply passage 74 and a supply pressure, and the fuel supply passage 74 has a hydraulic property so as to give a control capacity having a desired pressure/time.

Here, when the upper plunger 51 is driven downwardly due to a rotation of the cam, the timing fluid 56 is returned through the timing fluid passage 59 until the timing fluid passage 59 is closed by the lower portion of the upper plunger 51. The timing fluid 56 is trapped between the intermediate plunger 54 and the upper plunger 51, so that a hydraulic link for integrally moving all three plunger elements toward the nozzle 71, disposed on the bottom portion of the injection chamber 73, is formed. During downward motion of three plunger elements, when the timing fluid pressure becomes more than a maximum predetermined pressure determined by a resultant force of the valve spring 66 and the timing spring 65, the valve mechanism 70 is opened, so that the timing fluid 56 is discharged from the timing chamber 55 through the first and second drain passage 62 and 64 so as to reduce a pressure to conform to a predetermined limit value. Then, the supply orifice 75 of the fuel supply passage 74 is closed when the lower plunger 61 moves downwardly, so that a control of a fuel amount is finished. Further the lower plunger 61 moves downwardly, thereby injecting the controlled fuel in the injection chamber 73 from a plurality of orifices in the injection nozzle 71 within the combustion chamber (not shown).

However, the valve mechanism 70 mentioned above has a complex structure, so that a highly accurate dimension, flatness and the like are required for parts thereof. Further, since the valve mechanism 70 controls the pressure of the timing fluid 56, there is a problem in that an amount of leakage is not fixed due to a temperature, a viscosity, and the like of the fluid, so that the pressure is not fixed.

Further, in the case wherein the injection timing is controlled by an amount (a volume) of the timing fluid 56 supplied within the timing chamber 55, the amount of the timing fluid 56 is controlled by a magnitude of the timing fluid passage 59 and the control time. In accordance with the present publication, since the timing fluid is supplied through the timing fluid passage 59 in the form of the narrow fixed orifice, the amount of the timing fluid 56 is changed by a kind, a temperature, or a viscosity of the fluid, so that the injection timing is not fixed. On the contrary, when making the timing fluid passage 59 greater in cross-section, a range of the injection timing is narrowed. Further, when making the control time long, the volume of the timing chamber 55 is increased, so that there is a problem in that the fuel injector 50 itself becomes large.

Further, when controlling a little amount of fuel under a low rotational speed or a no load operation, it is necessary to make the timing fluid passage 59 of the fixed orifice narrow; however, when making it narrow, the control time becomes long in the case of intending to suddenly increase the fuel, so that a response of the engine is delayed. Particularly, in a vehicle having a great load change applied to the engine, such as a construction machine and the like, it is a great disadvantage that the response of the engine is delayed. Further, in the narrow fixed orifice, a dispersion (i.e., statistical variance) of the diameter thereof increases a rate of a dispersion in an area of the orifice, and increases a dispersion in the injection timing and the volume of the fuel.

In addition, the fuel to the injection chamber 73 is supplied via the supply orifice 75 in the fuel supply passage 74. The supply orifice 75 is also required to be made narrow for controlling a little amount of fuel at a time of the low rotational speed or the no load operation. However, when being made narrow, the control time becomes long in the case of intending to suddenly increase the fuel, so that there is a problem that the response of the engine is delayed.

SUMMARY OF THE INVENTION

An object of the present invention is to provide a fuel injection device for a diesel engine for solving the problems mentioned above, comprising a high pressure injection unit for a diesel engine having a wide range of injection timing, little dispersion, and a good response. In accordance with a first invention of the present invention, there is provided a fuel injection device for a diesel engine comprising a cylindrical body, an upper plunger, closely inserted within a hole of the body, to slide in a vertical direction responsive to an applied force from a cam, an intermediate plunger arranged below the upper plunger in such a manner as to be coaxial with the upper plunger and forming a pressure chamber for a hydraulic link with respect to the upper plunger, a lower plunger arranged below the intermediate plunger in such a manner as to be brought into contact with the intermediate plunger, and an injection chamber provided in a lower end portion of the body in which a fuel stored in the injection chamber is discharged by the lower plunger upon receiving an applied force from the upper plunger via the hydraulic link and the intermediate plunger, the improvement comprising:

a passage, having a large cross-sectional area, formed in the body for supplying a pressurized oil to the pressure chamber, the intermediate plunger is adapted to vertically move in response to an oil pressure so as to make it possible to change a volume of the pressure chamber, and a timing spring, having an end in contact with the intermediate plunger and the other end in contact with the lower plunger, to vertically move the timing plunger in response to the pressure.

In accordance with the structure mentioned above, in the case of rotating under no load and at a low rotational speed, an oil under a low pressure is supplied to the pressure chamber via the passage, and a fuel under low pressure is supplied to the injection chamber. Accordingly, in a downward slide motion, only the intermediate plunger is initially slid downward without moving the lower plunger downward, so that it is possible to delay the injection timing.

Further, in the case that the diesel engine rotates In under a high load and at a high rotational speed, the it pressurized oil under high pressure is supplied to the pressure chamber via the passage, and a large amount of fuel under high pressure is supplied to the injection chamber. Accordingly, in the downward slide motion, both the intermediate plunger and the lower plunger are immediately slid downward, so that fuel can be injected to a combustion chamber from the injection chamber at an early timing without delaying the injection timing.

As mentioned above, it is possible to obtain a delayed timing and an early timing by a simple structure, so that a predetermined range of injection timing can be easily obtained. That is, an injection timing having a predetermined range can be obtained by a delayed predetermined injection timing due to a predetermined interval between the intermediate plunger and the lower plunger at a low rotational speed under no load and an early injection timing at a high rotational speed in a state that there is no interval between the timing plunger and the lower plunger due to the pressure acting on the timing plunger at a high load.

Further, since the oil pressure and the oil amount are supplied to the pressure chamber via the passage, it is possible to quickly move to the early injection timing, so that a response of the engine can be improved. Further, since the timing spring is brought into contact with the lower plunger and both of them commonly move downward, there is an advantage that the pressure within the pressure chamber is not abnormally increased.

In accordance with a second invention, there is provided a fuel injection device for a diesel engine as In recited in the first invention, wherein the timing plunger has a first hole connected to the pressure chamber at a center portion and a second hole communicated with the first hole and passing through the timing plunger in a lateral direction, and the second hole communicates with a discharge hole provided below the passage when the timing plunger moves downward so as to discharge fuel collected in the injection chamber by the lower plunger.

In accordance with the structure mentioned above, the pressurized oil in the pressure chamber is discharged via the first hole, the second hole and the discharge hole when the timing plunger moves downward so as to restrict a movement of the lower plunger. Accordingly, the lower plunger does not press the body too much, so that it is possible to prevent the lower plunger or the body from breaking.

In accordance with a third invention, there is provided a fuel injection device for a diesel engine for injecting a fuel supplied via a fuel supply passage and stored in an injection chamber by a lower plunger responsive to an applied force from a cam through an upper plunger via a hydraulic link and a timing plunger comprising: a branch supply passage having an end connected to the fuel supply passage and the other end connected to the injection chamber; a variable valve to allow fuel to flow within the branch supply passage from the fuel supply passage only in a direction of the injection chamber, to open at a pressure equal to or more than a predetermined pressure of the supplied fuel, and to change a passing area in response to a pressure of the fuel; and a spring for the variable valve to set a moving amount of the variable valve in response to the pressure of the fuel.

In accordance with the structure mentioned above, the high pressure fuel discharged from the fuel pump of the engine is quickly supplied to the injection chamber. Since the high pressure fuel supplied to the injection chamber is supplied to the injection chamber also from the variable valve within the branch supply passage in addition to the fuel supply passage, the fuel is collected in the injection chamber with a good response. Since a large amount of fuel supplied to the injection chamber is injected into a combustion chamber by a downward slide motion at a high pressure, it is possible to increase an output force without decrease of the rotational speed of the engine, and a fast speed and a good response can be obtained.

In accordance with a fourth invention, there is provided a fuel injection device for a diesel engine comprising a cylindrical body, an upper plunger, closely inserted within a hole of the body, to slide in a vertical direction in response to an applied force from a cam, an intermediate plunger arranged below the upper plunger in such a manner as to be coaxial with the upper plunger and forming a pressure chamber for a hydraulic link with respect to the upper plunger, a lower plunger arranged below the intermediate plunger in such a manner as to be brought into contact with the intermediate plunger, and an injection chamber provided in a lower end portion of the body, structured such as to discharge a fuel supplied via a fuel supply passage and stored in the injection chamber by the lower plunger subject to the force from the upper plunger via the hydraulic link and the intermediate plunger, the improvement comprising:

a passage, having a large cross-sectional area and formed in the body, for supplying a pressurized oil to the pressure chamber, the intermediate plunger vertically movable in response to an oil pressure so as to make it possible to change a volume of the pressure chamber, a timing spring having an end being brought into contact with the intermediate plunger and the other end being brought into contact with the lower plunger and vertically moving the intermediate plunger in response to the oil pressure, a branch supply passage having an end connected to the fuel supply passage and the other end connected to the injection chamber, a variable valve to allow fuel to flow within the branch supply passage from the fuel supply passage only in a direction of the injection chamber, to open at a pressure equal to or more than a predetermined pressure of the supplied fuel, and to change a passing area in response to a pressure of the fuel, and a spring for the variable valve setting a moving amount of the variable valve in response to a pressure of the fuel.

In accordance with the structure mentioned above, since the oil pressure and the oil amount are supplied to the pressure chamber via the passage for the pressurized oil, it is possible to quickly move to an early injection timing, so that a response of the engine can be improved. Further, since the oil pressure and the oil amount are supplied to the pressure chamber via the passage for the pressurized oil, no narrow hole is required, so that a variability of the injection timing is reduced. Since the device is constituted by a simple structure comprising the intermediate plunger, or timing plunger, the timing spring and the like, the device is not of a large size.

Further, since the high pressure fuel supplied to the injection chamber is supplied to the injection chamber also from the variable valve within the branch supply passage in addition to the fuel supply passage, the fuel is collected with a good response. Since a large amount of fuel supplied to the injection chamber is injected to the combustion chamber by a downward slide motion of the lower plunger, an output force can be increased without reduction of the rotational speed of the engine, and a fast speed and a good response can be obtained.

BEST MODE FOR CARRYING OUT THE INVENTION

Hereinafter, an embodiment in accordance with a fuel injection device for a diesel engine of the present In invention will be described in detail below with reference to FIGS. 1 to 3.

Figure 1:
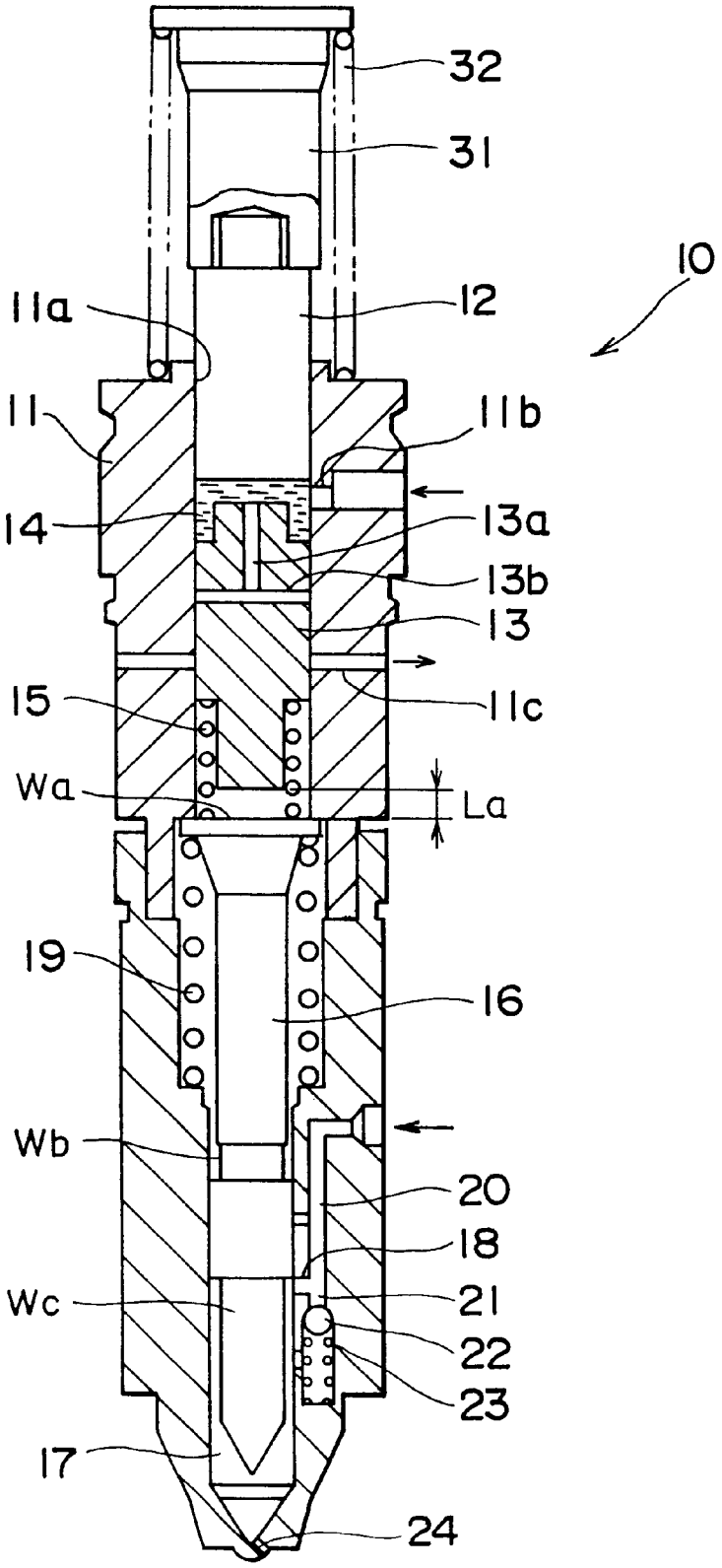
FIG. 1 is a cross sectional view of a high pressure injection unit in accordance with an embodiment of a fuel injection device for a diesel engine of the present invention.
Figure 2:
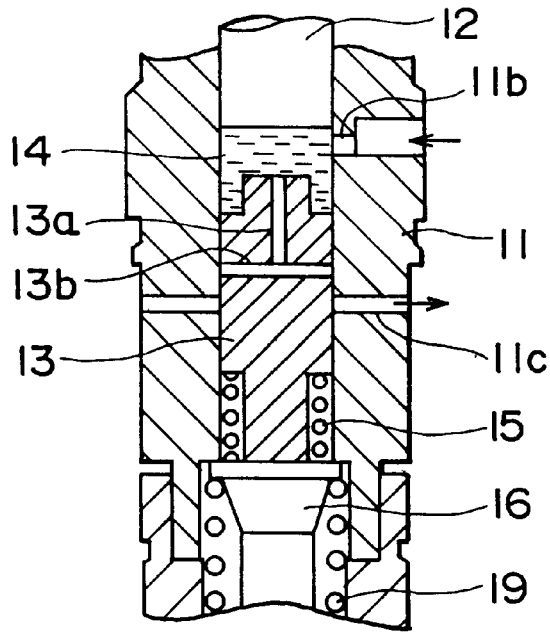
FIG. 2 is a cross sectional view of a timing plunger portion shown in FIG. 1 at a time of rotating under a load and at a high speed.

A cross section of a unit injector 10 for high pressure injection in accordance with the present embodiment will be shown in FIG. 1. Arrows in the drawing show flows of a fluid.

A body 11 is inserted and mounted within a hole in a cylinder head of an engine (not shown). The body 11 is formed in a cylindrical shape, an upper plunger 12 is closely inserted within a hole 11*a* thereof, and the upper plunger 12 slides in a vertical direction upon receipt of an applied force from a cam (not shown). A timing plunger 13 is arranged below the upper plunger 12 in such a manner as to be coaxial with the upper plunger 12, the timing plunger 13 is also closely inserted within the hole 11*a* of the body 11 and moves in a vertical direction. A pressure chamber 14 is formed between a lower end portion of the upper plunger 12 and an upper end portion of the timing plunger 13, and a pressurized oil is supplied here via a pressurized oil hole 11*b* formed in the body 11. The pressure chamber 14 has a function of a hydraulic link for transmitting a vertical motion of the upper plunger 12 to the timing plunger 13 via the pressurized oil. The pressurized oil hole 11*b* is formed in the body 11 at a position above the pressure chamber 14 and near a lower end surface of the upper plunger 12. In this case, the pressurized oil at about 15 bar to 25 bar discharged from a lubricating oil pump (not shown) of the engine is supplied to the pressure chamber 14.

The timing plunger 13 has a first hole 13*a* connected to the pressure chamber 14 in a center portion thereof, and a second hole 13*b* communicated with the first hole 13*a* and laterally extending through the timing plunger 13. The second hole 13*b* communicates with the discharge hole 11*c* formed in the body 11, below the pressurized oil hole 11*b*, when the timing plunger 13 moves downward. Accordingly, when the timing plunger 13 moves downward, the pressurized oil in the pressure chamber 14 is discharged via the first and second holes 13*a* and 13*b* and the discharge hole 11*c* so as to restrict movement of a lower plunger 16 mentioned below.

A timing spring 15, having an end brought into contact with the timing plunger 13 and the other end brought into contact with the lower plunger 16 to vertically move the timing plunger 13 in response to a pressure of an oil acting on the timing plunger 13 (the pressure chamber 14), is arranged below the timing plunger 13. The pressure of the oil in the pressure chamber 14 vertically moves the timing plunger 13, and the vertical motion changes a volume of the pressure chamber 14 so as to change an injection timing. That is, the injection timing is changed in response to the pressure of the oil acting on the pressure chamber 14. The pressure of the oil acting on the pressure chamber 14 changes in response to a rotational speed of the engine. For example, in the case that the rotational speed of the engine is fast, the pressure of the oil becomes high, so that the pressure chamber 14 greatly moves downward and the volume of the pressurized oil entering to the pressure chamber 14 is increased. Therefore, the injection timing is quickened.

Further, the lower plunger 16 is arranged below the timing plunger 13 at a predetermined interval La apart from the timing plunger 13. A timing spring 15 is brought into contact with an end surface Wa in an upper side (a side of the timing plunger 13) of the lower plunger 16. The end surface Wa is brought into contact with the body 11 and defines a position after the lower plunger 16 moves upward. A step portion Wb is provided in an intermediate portion of the lower plunger 16, and a fuel for cooling flows into the step portion Wb when the lower plunger 16 moves downward so as to cool the lower plunger 16. Further, a front end portion of the lower plunger 16 is formed in a slightly narrow manner, and a front end thereof is formed in a V shape. A fuel injection chamber 17 is formed between the front end portion formed in a slightly narrow manner and the V-shaped front end, and the body 11. A supply orifice 18 for supplying a fuel to the injection chamber 17 is formed in the body 11 at a step portion Wc constituted by the front end portion formed in a slightly narrow manner. An upper end of a lower plunger spring 19 is brought into contact with an upper side (a side of the timing plunger 13) of the lower plunger 16 so as to pull up the lower plunger 16 and bring the lower plunger into contact with the body 11. A tensile stress of the lower plunger spring 19 is set stronger than a tensile stress of the timing spring 15. A lower end of the lower plunger spring 19 is brought into contact with the lower body 11.

Figure 3:
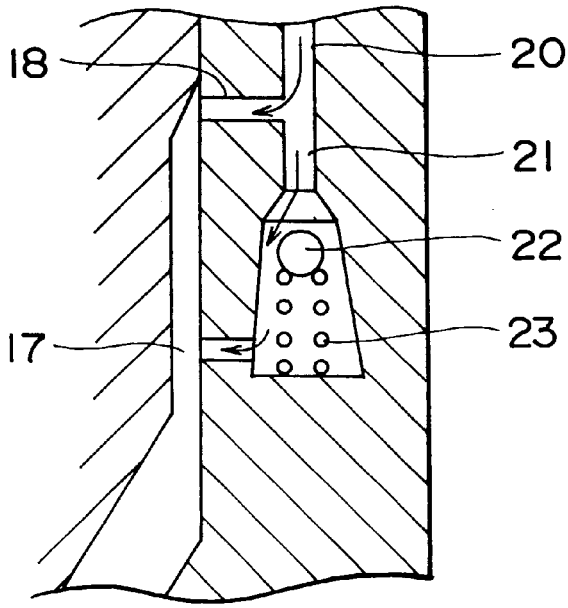
FIG. 3 is an enlarged cross sectional view of a variable valve portion shown in FIG. 1 at a time of rotating under a load and at a high speed.
Figure 4:
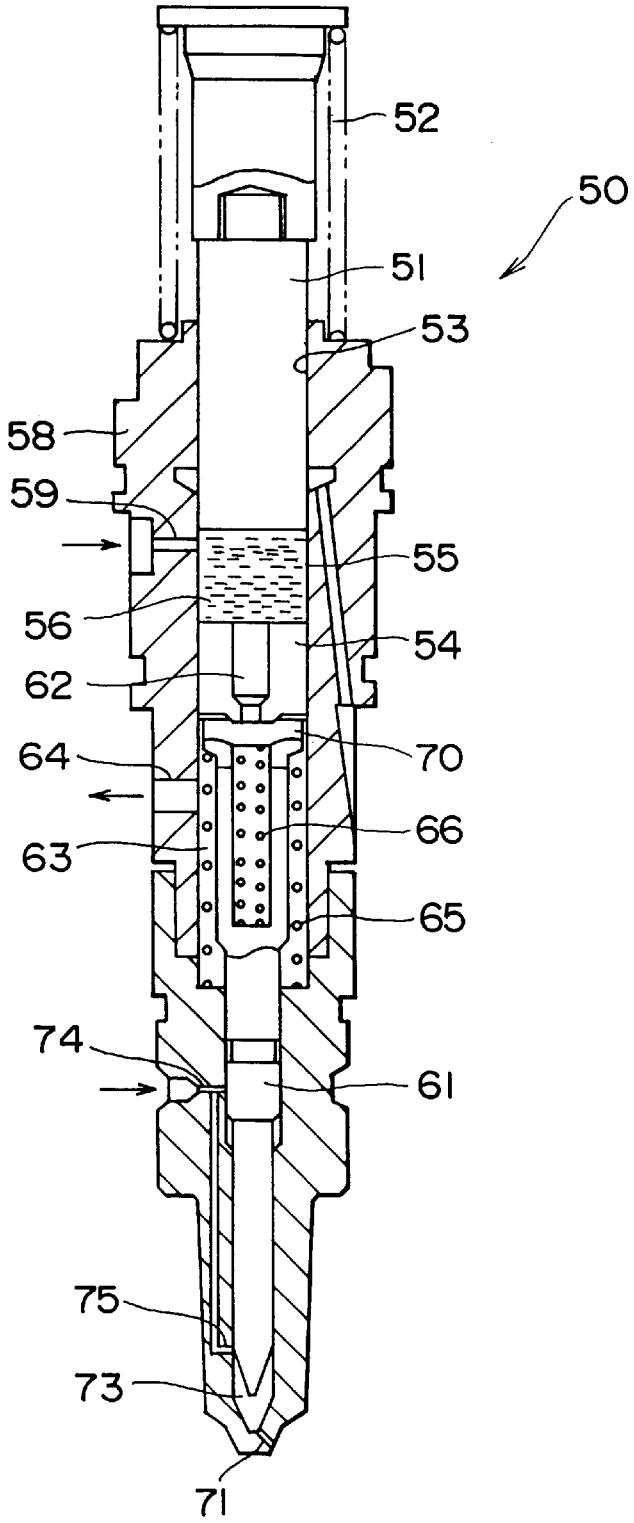
FIG. 4 PRIOR ART
FIG. 4 is a cross sectional view of a conventional fuel injection device for a diesel engine.

Further, a branch supply passage 21 is connected to a fuel supply passage 20 provided in the body 11 in such a manner as to branch from the fuel supply passage 20 as shown in FIG. 3. A variable valve 22 and a spring 23 for the variable valve are subsequently arranged within the branch supply passage 21, and the branch supply passage 21 is connected to the injection chamber 17 via them.

The variable valve 22 opens when the fuel is equal to or more than a predetermined pressure, thereby allowing fuel from the fuel supply passage 20 to flow only in a direction of the injection chamber 17. Further, the variable valve spring 23 can change a fuel passing area in the variable valve 22 by setting a moving amount of the variable valve 22 in response to a pressure of the fuel. Accordingly, the pressure of the fuel supplied to the injection chamber 17 is changed in response to a sudden change of the rotational speed of the engine, and the fuel passing area of the variable valve 22 is changed in response to the pressure thereof. The fuel at about 15 bar to 25 bar discharged from the fuel pump in the engine (not shown) is supplied to the fuel supply passage 20.

The fuel in the injection chamber 17 is injected to a combustion chamber (not shown) through a nozzle hole 24 provided in a front end of the body 11. As mentioned above, the fuel supplied to the injection chamber 17 is increased in response to a sudden change of the rotational speed of the engine so as to improve a response of the engine.

On the other hand, a collar 31 is mounted to an upper end of the upper plunger 12 as shown in FIG. 1. An upper plunger spring 32 is arranged between the collar 31 and the upper portion of the body 11. The upper plunger spring 32 has an end brought into contact with the collar 31 and the other end brought into contact with the upper portion of the body 11 and lifts up the upper plunger 12 via the collar 31 so as to define a position of the upper plunger 12. The upper limit position thereof is defined by a position brought into contact with a cap (not shown). The upper plunger 12 receives an applied force from a cam (not shown) and slides against the upper plunger spring 32 in a downward direction.

Next, an operation in the structure mentioned above will be described below.

In the case that the diesel engine starts and rotates under no load and oil at low pressure (e.g., about 15 bar) is discharged from the lubricating oil pump and the like and is supplied to the pressure chamber 14 via the pressurized oil hole 11*b*. Accordingly, the timing plunger 13 slides downward against the timing spring 15 a slight amount. At this time, the timing plunger 13 and the lower plunger 16 are apart from each other at an interval Lb (not shown) slightly smaller than the predetermined interval La (La>Lb). At the same time, fuel at low pressure (e.g., about 15 bar) is discharged from the fuel pump of the engine and is supplied to the fuel supply passage 20. The low pressure fuel supplied to the fuel supply passage 20 is supplied to the injection chamber 17 from the supply orifice 18 at a lesser amount.

In this state, the upper plunger 12 applies a force from the cam slides downward against the upper plunger spring 32 so as to first close the pressurized oil hole 11*b*. When the upper plunger 12 further moves downward, the pressure within the pressure chamber 14 increases from about 15 bar so as to slide the timing plunger 13 downward against the timing spring 15. At this time, since the timing spring 15 is brought into contact with the lower plunger 16 so as to move downward together, the pressure within the pressure chamber 14 is not abnormally increased. This downward slide motion slides only the timing plunger 13 downward without moving the lower plunger 16 downward. When the timing plunger 13 is brought into contact with the lower plunger 16 due to a further downward slide motion, the timing plunger 13 and the lower plunger 16 both slide downward. Due to the slide motion of the lower plunger 16, a small amount of fuel supplied to the injection chamber 17 is injected to the combustion chamber at a high pressure. The interval Lb for sliding only the timing plunger 13 downward without moving the lower plunger 16 downward mentioned above delays the injection timing.

In the case that the diesel engine rotates under a high load and at a high rotational speed, oil at high pressure (e.g., about 25 bar) is discharged from the lubricating oil pump and the like and is supplied to the pressure chamber 14 via the pressurized oil hole 11*b*. Accordingly, as shown in FIG. 2, the timing plunger 13 greatly slides downward until being brought into contact with the lower plunger 16 against the timing spring 15. Therefore, the predetermined interval La between the timing plunger 13 and the lower plunger 16 is lost. At the same time, fuel at high pressure (e.g., about 25 bar) is discharged from the fuel pump of the engine and is supplied to the fuel supply passage 20. The fuel at a high pressure is supplied to the injection chamber 17 from the supply orifice 18 and the variable valve 22 at a large amount.

In this state, the upper plunger 12 applies a force from the cam slides downward against the upper plunger spring 32 so as to first close the pressurized oil hole 11*b*. When the upper plunger 12 further moves downward, the pressure within the pressure chamber 14 increases from about 25 bar so as to slide the timing plunger 13 downward. The downward slide motion of the timing plunger 13 immediately slides the contact lower plunger 16 together. Due to the downward slide motion of the lower plunger 16, a large amount of fuel supplied to the injection chamber 17 is injected to the combustion chamber at a high pressure. At this time, since the lower plunger 16 immediately slides downward, the fuel can be injected to the combustion chamber from the injection chamber 17 at a high pressure at an early timing without delaying the injection timing.

In the case that the diesel engine rotates under no load and at a high rotational speed, oil at an intermediate pressure (e.g., about 20 bar) is discharged from the lubricating oil pump and the like and is supplied to the pressure chamber 14 via the pressure oil hole 11*b*. Accordingly, the timing plunger 13 slides downward against the timing spring 15. In this case, the timing plunger 13 and the lower plunger 16 are apart from each other at an interval Lc (not shown) slightly smaller than the interval Lb mentioned above (Lb>Lc). At the same time, fuel at an intermediate pressure (e.g., about 20 bar) is discharged from the fuel pump of the engine and is supplied to the fuel supply passage 20. The fuel at the intermediate pressure is supplied to the injection chamber 17 only from the supply orifice 18 at a predetermined amount.

In this state, the upper plunger 12 applies a force from the cam slides downward against the upper plunger spring 32 so as to first close the pressurized oil hole 11*b*. When the upper plunger 12 further moves downward, the pressure within the pressure chamber 14 increases from about 20 bar so as to slide the timing plunger 13 downward against the timing spring 15. The downward slide motion slides only the timing plunger 13 downward a slight amount without moving the lower plunger 16 downward. When the timing plunger 13 further moves downward so as to be brought into contact with the lower plunger 16, both slide downward together. Due to the downward slide motion of the lower plunger 16, a small amount of fuel supplied to the injection chamber 17 is injected to the combustion chamber at a high pressure. Sliding only the timing plunger 13 downward a slight amount, interval Ld (not shown), without moving the lower plunger 16 downward, where interval Ld is slightly smaller than the interval Lc (Lc>Ld), delays the injection timing.

In this case, when a load is applied to the engine, oil at high pressure (e.g., about 25 bar) is discharged from the lubricating oil pump and the like and is quickly supplied to the pressure chamber 14 via the large pressurized oil hole 11*b*. Accordingly, the timing plunger 13 further slides downward a slight amount against the timing spring 15 until being brought into contact with the lower plunger 16. As a result, the interval between the timing plunger 13 and the lower plunger 16 is lost.

At the same time, fuel at high pressure (e.g., 25 bar) is discharged from the fuel pump of the engine and is quickly supplied to the fuel supply passage 20. The fuel at the high pressure is supplied to the injection chamber 17 from the variable valve 22 of the branch supply passage 21 in addition to the supply orifice 18. Due to the to downward slide motion of the lower plunger 16, a large amount of fuel supplied to the injection chamber 17 is injected to the combustion chamber at a high pressure. Therefore, it is possible to increase an output without reducing the rotational speed of the engine. Farther, early injection timing and good response can be obtained.

In accordance with the present invention, a wide range of injection timing can be obtained by delays obtained by the predetermined interval La between the timing plunger 13 and the lower plunger 16 at a time of operation under no load and at a low rotational speed and an early injection timing at a high rotational speed obtained by a state of no interval between the timing plunger 13 and the lower plunger 16 caused by the pressure acting on the timing plunger 13 at a time of an operation under a high load.

Since the oil pressure and the oil amount are supplied to the pressure chamber 14 via the large pressurized oil hole 11*b*, it is possible to quickly move to the early injection timing, so that a response of the engine can be improved. Since no narrow hole is used, a dispersion of the injection timing is small.

Further, since the device is constituted by a simple structure comprising the timing plunger 13 and the timing spring 15, the device is not made of a large size.

INDUSTRIAL APPLICABILITY

The present invention is useful for a high pressure injection unit for a diesel engine having a wide injection timing, small dispersion, good response and simple structure.

What is claimed is:

1. A fuel injection device for use with an engine, the device comprising:

a body having a longitudinal channel, an injection chamber in communication with the longitudinal channel, and a first fuel supply passage in communication with the injection chamber;

a first plunger, a second plunger, and an intermediate plunger, said first plunger, at least partially positioned within the longitudinal channel, to receive an applied force to effect a discharge of fuel from the device;

said second plunger, having a first end positioned within the injection chamber, to effect a discharge of fuel from the injection chamber in response to an applied force;

said intermediate plunger positioned within the longitudinal channel and disposed between said first plunger and said second plunger; and a second fuel supply passage, in communication with the injection chamber and extending axially downstream of the fist fuel supply passage, to supply additional fuel to the injection chamber during an increase in fuel demand on the engine as indicated by a fuel pressure within the first fuel supply passage reaching a prescribed fuel pressure, the second fuel supply passage including:

a valve to control a fuel flow through the second fuel supply passage such that fuel passes through the second fuel supply passage when the prescribed fuel pressure is reached, and a spring, in contact with the valve, to bias the valve in a closed position and to allow the valve to open at the prescribed fuel pressure.

2. A device in accordance with claim 1, wherein a timing fluid pressure chamber is variably defined between an upper surface of the intermediate plunger and a lower surface of the first plunger.

3. A device in accordance with claim 2, further comprising a timing spring, positioned between the intermediate plunger and the second plunger, to maintain a prescribed space between the intermediate plunger and the second plunger in at least a non-actuated state, wherein the prescribed space defines a range of injection timings for the device.

4. A device in accordance with claim 2, wherein the body further includes a timing fluid discharge outlet, and the intermediate plunger has a first passage and a second passage formed therein.

5. A device in accordance with claim 4, wherein the first passage extends between the timing fluid pressure chamber and the second passage, and wherein the intermediate plunger is adapted to allow the second passage to selectively communicate with the timing fluid discharge outlet during operation of the device to effect a discharge of timing fluid from the timing fluid pressure chamber.

6. A device in accordance with claim 2, wherein the body further includes a timing fluid inlet having a large cross-sectional area, wherein the timing fluid inlet is adapted to selectively communicate with the timing fluid pressure chamber during operation of the device.

7. A device in accordance with claim 1, wherein the second fuel supply passage is included within the body.

8. A fuel injection device for use with an engine, the device comprising:

a body having a timing fluid inlet, a longitudinal channel, an injection chamber in communication with the longitudinal channel, and a first fuel supply passage in communication with the injection chamber;

a first plunger, at least partially positioned within the longitudinal channel, to receive an applied force to effect a discharge of fuel from the device;

a second plunger, positioned within the longitudinal channel, wherein a timing fluid pressure chamber is variably defined between an upper surface of the second plunger and a lower surface of the first plunger;

a third plunger, having a first end positioned within the injection chamber, to effect a discharge of fuel from the injection chamber in response to an applied force from the second plunger;

a timing spring, having one end contacting the second plunger and another end contacting the third plunger, to operatively separate the second plunger and the third plunger by a variable space when the second plunger is subject to an applied force below a proscribed level, wherein the variable space defines a range of injection timings for the device; and a second fuel supply passage, in communication with the injection chamber and extending axially downstream of the first fuel supply passage, to supply additional fuel to the injection chamber during an increase in fuel demand on the engine as indicated by a fuel pressure in the first fuel supply passage reaching a prescribed fuel pressure, the second fuel supply passage including:

a valve to control a fuel flow through the second fuel supply passage, wherein actuation of the valve is determined by the prescribed fuel pressure within the first fuel supply passage, and a spring, in contact with the valve, to bias the valve to a closed position and set the prescribed fuel pressure necessary to open the valve, wherein the timing fluid inlet is adapted to selectively communicate with the timing fluid pressure chamber during operation of the device.

9. A device in accordance with claim 8, wherein the body further includes a timing fluid discharge outlet, and the second plunger has a first passage and a second passage formed therein.

10. A device in accordance with claim 9, wherein the first passage extends between the timing fluid pressure chamber and the second passage, and the second plunger is adapted to allow the second passage to selectively communicate with the timing fluid discharge outlet during operation of the device to effect a discharge of timing fluid from the timing fluid pressure chamber.

* * * * *